US007500296B2

(12) United States Patent
Bertsch et al.

(10) Patent No.: US 7,500,296 B2
(45) Date of Patent: Mar. 10, 2009

(54) TEXTURING NOZZLE AND METHOD FOR THE TEXTURING OF ENDLESS YARN

(75) Inventors: Gotthilf Bertsch, Ednat-Kappel (CH); Kurt Klesel, Wolfhalden (CH)

(73) Assignee: Oerlikon Heberlein Temco Wattwil AG, Wattwil (CH)

( * ) Notice: Subject to any disclaimer, the term of this patent is extended or adjusted under 35 U.S.C. 154(b) by 591 days.

(21) Appl. No.: 10/470,078

(22) PCT Filed: Mar. 28, 2003

(86) PCT No.: PCT/CH03/00204

§ 371 (c)(1),
(2), (4) Date: Nov. 7, 2005

(87) PCT Pub. No.: WO2004/085722

PCT Pub. Date: Oct. 7, 2004

(65) Prior Publication Data

US 2006/0064859 A1 Mar. 30, 2006

(51) Int. Cl.
*D02G 1/16* (2006.01)

(52) U.S. Cl. ..... 28/271; 28/254

(58) Field of Classification Search ..... 28/271, 28/274, 275, 276, 273, 254, 272, 257, 258; 57/333, 350, 908, 289
See application file for complete search history.

(56) References Cited

U.S. PATENT DOCUMENTS 3,911,655 A * 10/1975 London et al. ..... 57/289
4,188,692 A * 2/1980 Pike ..... 28/271
4,251,904 A * 2/1981 Sano et al. ..... 28/274
4,507,833 A 4/1985 Simmen et al.
4,934,133 A * 6/1990 Stalder et al. ..... 57/333
5,423,859 A * 6/1995 Koyfman et al. ..... 606/228
5,481,787 A * 1/1996 Sano et al. ..... 28/276
5,640,745 A 6/1997 Bertsch et al.
6,088,892 A 7/2000 Bertsch et al.

(Continued)

FOREIGN PATENT DOCUMENTS

DE 195 80 019 C1 9/1996

(Continued)

OTHER PUBLICATIONS

"A Study of Air-Jet Texturing Nozzles: The Effects of Nozzle Configuration on the Air Flow," Transactions of the ASME: Journal of Engineering for Industry, by A. Demir, vol. 112/97, Feb. 1990.

*Primary Examiner*—Amy B Vanatta
(74) *Attorney, Agent, or Firm*—Shoemaker and Mattare

(57) ABSTRACT

The invention relates to a method for the texturing of endless yarn by means of a texturing nozzle having a continuous yarn duct into which compressed air at a pressure higher than 4 bar is blown in the direction of the yarn conveyance, whereby the yarn duct is preferably conically widened at the outlet end with a widening angle larger than 10° for generating a supersonic flow. The invention furthermore relates to a texturing nozzle for the texturing of endless yarn with a continuous yarn duct having an inlet end, a central, preferably cylindrical portion with an air supply orifice as well as a preferably conical outlet end with a widening angle larger than 10°, but smaller than 40°.

27 Claims, 12 Drawing Sheets

U.S. PATENT DOCUMENTS

| | | | | |
|---|---|---|---|---|
| 6,564,438 | B1 | 5/2003 | Bertsch et al. | |
| 6,834,417 | B1 * | 12/2004 | Buchmuller | 28/271 |
| 7,353,575 | B2 * | 4/2008 | Buchmuller | 28/271 |

FOREIGN PATENT DOCUMENTS

| | | | |
|---|---|---|---|
| EP | 0 088 254 | A2 | 9/1983 |
| EP | 0 088 254 | B1 | 9/1983 |
| EP | 0 880 611 | B1 | 8/2001 |
| EP | 1 058 745 | B1 | 2/2002 |
| WO | WO 97/30200 | | 8/1997 |
| WO | WO 99/45182 | | 9/1999 |

* cited by examiner

TEXTURING NOZZLE AND METHOD FOR THE TEXTURING OF ENDLESS YARN

TECHNICAL FIELD

The novel invention relates to a method for the texturing of endless yarn by means of a texturing nozzle having a continuous yarn duct into which compressed air at a pressure of more than 4 bar is blown in the direction of the yarn conveyance, whereby the yarn duct is preferably conically widened at the outlet end with a widening angle larger than 10° for generating a supersonic flow. The invention further relates to a texturing nozzle for the texturing of endless yarn with a continuous yarn duct having an inlet end, a central—preferably cylindrical—portion with an air supply orifice as well as an outlet end with a widening angle larger than 10°.

STATE OF THE ART

The term texturing is partly still understood as the processing of spun filament bundles and the corresponding endless yarns, respectively, with the aim of rendering a textile character to the yarn. In the following description, the term texturing shall designate the generation of a multitude of loops on single filaments and the production of loop yarn, respectively. An older solution for texturing is described in the EP 0 088 254. The endless filament yarn is supplied to the yarn driving duct at the inlet end of a texturing nozzle and textured at a trumpet-shaped outlet end through the forces of a supersonic flow. The central portion of the yarn driving duct is of a continuous cylindrical shape with a constant cross section. The inlet is slightly rounded for a smooth supply of the untreated yarn. At the trumpet-shaped outlet end there is an impact member, whereby the looping takes place between the trumpet-shape and the impact member. The yarn is fed to the texturing nozzle at high excess delivery. The excess delivery is required for the looping on each individual filament causing an increased titer at the outlet end.

The EP 0 088 254 was based on a device for texturing at least one endless yarn consisting of a multitude of filaments with a nozzle charged with a compressed medium, having a yarn driving duct as well as at least one admission for the compressed medium discharging into the duct in radial direction. The generic nozzle had an outlet of the duct widening in external direction and an impact member in the shape of a ball and a hemisphere, respectively, protruding into the duct and forming an annular gap with the latter. It was noted that for textured yarns the preservation of the yarn features both during and after the processing procedure for the finished product is an important criterion for possible uses of such yarns. Moreover, the extent of the degree of mixing of two or more yarns and of the individual filaments of textured yarns is also of essential importance for obtaining a uniform appearance of the product. In this context, the stability is a quality standard. The instability of the yarn is determined by forming small hanks of yarn with four coils having a circumference of one meter each on a reel, as explained by means of a multifilament yarn for polyester of the titer 167f68 dtex. These small hanks are then subjected to a test load of 25 cN for one minute and the length X is measured. The yarn is subsequently subjected to a test load of 1250 cN for another minute. After relieving the load for one minute, the small hank is again subjected to a load of 25 cN and after another minute the length Y is measured. This provides the value for the instability:

$$I = \frac{Y \cdot X}{X} \cdot 100\%$$

The instability indicates the percentage of lasting stretching caused by the applied load. The EP 0 088 254 dealt with the task of providing an improved device of the described type with which an optimum texturing effect can be achieved which ensures a high stability of the yarn and a high degree of mixing of the individual filaments. As a solution it was proposed that the outer diameter of the convexly curved outlet aperture of the duct is at least equivalent to the fourfold of the diameter of the duct and at least equivalent to the 0.5-fold of the diameter of the ball- or hemisphere-shaped impact member (5). Optimum results were obtained for production rates in the range between 100 and more than 600 m/min. Interestingly, the applicant successfully marketed corresponding nozzles for more than 15 years. The quality of the yarn manufactured with these nozzles was assessed as very good for a period of 1½ decades. Increasingly, however, an improved performance was desired. The applicant managed with the solution in accordance with the EP 0 880 611 to obtain a massively improved performance of a yarn conveyance rate of up to much more than 1000 m/min. The central concept for the increase in performance resided in the intensification of the flow conditions in the widening supersonic duct, i.e. in the zone in which the looping takes place. The yarn tension at the outlet of the texturing nozzle was identified as a specific test criterion. Many test series revealed that for the solution in accordance with the EP 0 088 254, the yarn tension considerably decreases for a yarn conveyance rate above 600 m/min. This is eventually the explanation for the performance limit of these types of nozzle.

The intensification of the flow in the supersonic duct proposed in the EP 0 880 611 provided an unexpected rise in the yarn tension, which allowed an increase of the conveyance speed to more than 1000 m/min. The quality of the processed yarn was initially evaluated as identical if not better including for highest conveyance rates. However practical experience has later shown surprises insofar as that in many applications the quality of the yarn did not meet desired requirements.

The task of the novel invention has now been to develop a method and a texturing nozzle which allow for an increase in performance in particular well above 1000 m/min, but at the same time provide highest yarn qualities in all areas of applications if possible.

DESCRIPTION OF THE INVENTION

The method in accordance with the invention is characterized in that the compressed air for an intensified opening of the yarn is supplied to the yarn duct at a supply angle of more than 48°, in particular more than 50°.

All previous examinations could only confirm that for data established with texturing nozzles in accordance with the EP 0 088 254 the optimum supply angle for the treatment air is at 48°. Any increase beyond 48° only caused a deterioration of the texturing. In this respect, reference is also made to the large-scale examination of A. Demir in the "Journal of Engineering for Industry" of February 1990 (vol. 112/97). The author of the article had the opportunity to test the essential parameters in many test series. Nozzles with supply angles of 30°, 45° and 60° were tested in these series. The performance of nozzles with supply angles of 60° was poor in several aspects, not last because at 60° a large part of the energy impacts on the opposite wall and is destroyed. This provided the scientific corroboration of what had been found empirically in the course of the development of the texturing nozzle in accordance with the EP 0 088 254 and had no longer been doubted subsequently. For the development of the new nozzle shape in accordance with the EP 0 880 611 there was no reason to doubt the opinion of experts, which had been firmly established over the years, i.e. that the range between 45° and 48° represented an optimum supply angle. This characteristic was hence also reflected in the description of the solution in accordance with the EP 0 880 611.

As already discussed, in the context of efforts at improving yarn qualities, a new attempt was made i. a. as regards the influence of the supply angle. As a complete surprise it was noted that the expansion of the supply angle with nozzles in accordance with the EP 0 880 611 provided already in the first test series an unexpected increase in quality of the textured yarn. Subsequently, the inventors observed that the two process zones of opening the yarn, and texturing the yarn need to be optimally geared to one another. Repeated tests showed that for the solution in accordance with the EP 0 880 611 the limitation rests with the texturing zone and that consequently an increase of the yarn opening is only disadvantageous. It is known from the area of yarn intermingling that the effect of the yarn opening is largest at a supply angle of 90°. The objective of intermingling is to form regular knots in the yarn. Reference is made to the DE 195 80 019 which gives an example for intermingling. For textured yarn, however, knots may not be formed at any circumstance. There must be a limit zone for the supply angle for the two basically different methods of knot formation and looping. However, these limits could not yet be determined. To date a range for the supply angle is assumed between 49° and 80°, preferably between 50° and about 70°. The upper limit could not yet be definitely established. The yarn duct has a central, preferably cylindrical portion, which continues smoothly into the conical widening in the direction of conveyance, whereby the compressed air is supplied in a sufficient distance to the conically widened supersonic duct in the cylindrical portion.

The tests conducted in connection with the novel invention essentially provided the following three findings.

For texturing nozzles with intensified supersonic flow in accordance with the EP 0 880 611 an improved quality was obtained for each yarn titer if the supply angle was raised over 48°.

The increase in quality starts with a marked rise as the angle is increased over 48°.

For supply angles exceeding 52°, partly up to 60° and even 65°, the yarn quality remains remarkably constant. The optimum supply angle depends, however, also on the yarn titer.

It is therefore proposed to fix the supply angle as a function of the yarn quality, in particular of the yarn titer, in the range between 48° and 80°, preferably between 50° and 70°. The advantages of the novel invention can be exploited with texturing nozzles having only a single orifice through which the compressed air is supplied at an angle exceeding 48° and 50°, respectively. It is, however, preferred to have the compressed air supplied to the yarn duct through three orifices staggered in the circumference by 120°. In any case it is decisive that the opening of the yarn is intensified by supplying the compressed air to the yarn duct, but that a formation of knots in the yarn is avoided.

The texturing nozzle in accordance with the invention is characterized in that the compressed air for the intensification of the yarn opening is supplied to the yarn duct in a supply angle of more than 48°, preferably 50°. Preferably, the air supply location is arranged in the cylindrical portion with a distance to the conical widening, whereby the distance is at least equivalent to the diameter of the yarn duct. Pursuant to the current knowledge, the length of the two process stages, i.e. opening and texturing, is too short for nozzles in accordance with the older the EP 0 088 254. This is one of the reasons for the limited conveyance rate achieved with a type of nozzle in accordance with the older solution.

The novel invention established various findings:

1. The opening of the yarn on the one hand and the texturing of the yarn on the other must be optimized individually.
2. In order to optimize these two completely different functions they must be conducted at separated locations,
3. but one shortly after the other, such that the opening takes place immediately prior to the texturing and that the completion of the yarn opening process immediately blends over into the texturing, respectively.

At least the central cylindrical portion as well as the conically widened outlet portion of a texturing nozzle are provided as part of the nozzle core. The nozzle core is preferably provided as an insert inside a texturing nozzle head and made of a material resistant to wear, in particular ceramic.

It is particularly advantageous if the nozzle core is provided as a removable core such that a nozzle core with optimum internal dimensions and inlet angles can be inserted. This allows e.g. removal of an existing state-of-the-art nozzle core by a few manipulations and use of all advantages of the novel invention. At the outlet end of the conically widened portion an impact member is arranged as with the state of the art, which can be adjusted at least closely to the conically widened outlet portion. This further contributes to the constancy of the yarn quality. The texturing nozzle is advantageously provided as a part of the texturing head, whereby the air distribution is arranged on three air supply orifices in the texturing head. Hereinafter, reference is made to the EP 0 880 611, which is the basis and starting point for the novel invention insofar as the process stage of texturing is concerned.

It was found in the EP 0 880 611 that the key to quality resides in the yarn tension after the texturing nozzle. The quality can be improved only if the yarn tension is increased. The breakthrough was possible when the flow of the air jet was increased above the range of Mach 2. Numerous test series confirmed that not only the quality is improved but also the quality is adversely affected to an amazingly small extent by an increase in the production rate. Already a slight increase in the Mach number above 2 produced significant results. The best explanation of the corresponding intensification of the texturing process resides in the fact that the difference in the rate is increased directly before and after the shock wave, which directly affects the corresponding forces of action by the air on the filaments. The increased forces in the area of the shock wave cause an increase in the yarn tension. The action at the shock wave is increased directly by raising the Mach number. In accordance with the invention the following rule was recognized: higher Mach number=stronger shock=more intense texturing. The intensified supersonic flow grasps the individual filaments of the opened yarn over a broader front and much more intensely, such that no loops can escape laterally beyond the zone of action of the shock wave. As the production of the supersonic flow in the acceleration duct is based on expansion, an increase and almost a doubling of the effective outlet cross section is obtained as a result of the higher Mach range, for instance Mach 2.5 instead of Mach 1.5. Various surprising observations were made, which were also confirmed in combination with the novel invention:

- When using a supersonic duct designed for the higher Mach range, a qualitative improvement in texturing occurred—as compared to the prior art—at an identical production rate.
- Tests with individual yarn titers were carried out up to a production rate of 1,000 to 1,500 m/min without a breakdown of texturing.
- By measurement it was noted immediately that the yarn tension could be increased by an average of about 50%. The increased value also remained almost constant over a great speed range e. g. between 400 and 700 m/min.
- It was also established that the choice of the supply pressure of the compressed air is a significant influencing factor. A higher supply pressure is required in many cases to ensure the higher Mach numbers. This is normally between about 6 and 14 bar, can however also be increased to 20 bar and above.

The comparison tests, state of the texturing art in accordance with the EP 0 088 254 and a novel solution pursuant to the EP 0 880 611 proved the following rule in a remarkably wide range: The quality of texturing is at least equal if not better with a supersonic duct designed for the lower Mach range at a higher production rate as compared to the quality of texturing at a lower production rate. The texturing process is so intense at air speeds in the shock wave higher than Mach 2, e. g. at Mach 2.5 to Mach 5, that even at maximum yarn passage rates all loops are adequately picked and bound well into the yarn almost without exception. The generation of an air speed in a high Mach range has the effect within the acceleration duct that texturing no longer breaks down including at maximum speeds. Secondly the entire filament assembly is guided uniformly and directly into the shock wave within clear outer duct delineations. The actual focal criterion for the positive effect of the novel invention resides in the fact that the stability of the yarn is generally improved. If a strong tensile force is applied to and taken away from the yarn textured in accordance with the new solution, it is noted that the texture, i. e. the firm assembly locations and loops, is preserved almost unchanged. This is a decisive factor for the subsequent processing.

In the acceleration duct the yarn is drawn in by the accelerating air flow via the corresponding path in the acceleration duct, opened further and transferred to the adjacent texturing zone. The air jet is then guided to the acceleration duct without deflection through an irregularly and markedly widening portion. One or more yarn filaments can be introduced with identical or different excess delivery and textured at a production rate between 400 and above 1,200 m/min. The compressed air jet in the supersonic duct is accelerated to between 2.0 and 6 Mach, preferably to between 2.5 and 4 Mach. The best results are achieved when the outlet end of the yarn duct is limited by an impact member such that the textured yarn is discharged through a gap roughly at a right angle to the axis of the yarn duct.

Particularly preferably the air jet is guided including for the novel invention pursuant to the radial principle from the feed location into a cylindrical portion of the yarn duct directly in an axial direction at a roughly constant speed to the acceleration duct. As in the state of the art of the EP 0 880 611, one or more yarn filaments can also be textured with the most varied excess delivery with the novel method. The total theoretically effective widening angle of the supersonic duct from the smallest to the largest diameter should preferably be greater than 10° but smaller than 40°, preferably within the range between 15° and 30°. The currently available roughness values have led to an upper limit angle (total angle) between 35° and 36° in the production of series. The compressed air is accelerated substantially steadily in a conical acceleration duct. The nozzle duct portion immediately before the supersonic duct is preferably substantially cylindrical in design, air being supplied into the cylindrical portion with a conveying component in the direction toward the acceleration duct. The intake force on the yarn is increased with the length of the acceleration duct. The nozzle widening and the increase of the Mach number, respectively, provides the intensity of texturing. The acceleration duct should at least have a cross-sectional enlargement range of 1:2.0, preferably 1:2.5 or greater. It is further proposed that the length of the acceleration duct be 3 to 15 times, preferably 4 to 12 times greater than the diameter of the yarn duct at the beginning of the acceleration duct. The acceleration duct can be widened completely or partially steadily, can have conical portions and a slightly spherical shape, respectively. However, the acceleration duct can also be designed in fine steps and have different acceleration zones having at least one zone with a high acceleration and at least one zone with a low acceleration of the compressed air jet. The outlet area of the acceleration duct can also be cylindrical or approximately cylindrical and the inlet area can be markedly widened, but the widening will be less than 36°. If the marginal conditions for the acceleration duct are maintained in accordance with the invention, said variations in the acceleration duct have proven to be almost corresponding or at least equivalent. Behind the supersonic duct, the yarn duct has a markedly convex yarn duct mouth which is preferably widened by more than 40° in the form of a trumpet, whereby the transition from the supersonic duct into the yarn duct preferably runs unsteadily. A decisive factor was found to reside in the fact that the pressure conditions in the texturing chamber can be positively influenced and can be kept stable in particular with an impact member. A preferred embodiment of the texturing nozzle in accordance with the invention is characterized in that it has a continuous yarn duct with a central cylindrical portion into which the air supply opens and, in the direction of yarn travel, a conical acceleration duct immediately following the cylindrical portion, with an opening angle ($\alpha_2$) greater than 15°, as well as an adjacent widening portion with an opening angle ($\delta$) greater than 40°.

BRIEF DESCRIPTION OF THE INVENTION

Further details of the invention are now described by means of several embodiments.

FIG. 7*a* through 7*c* and FIG. 8*a* through 8*c* show the test results as related to various supply angles base on a nozzle in accordance with the state of the art having a supply angle of 48°.

Figure 9:
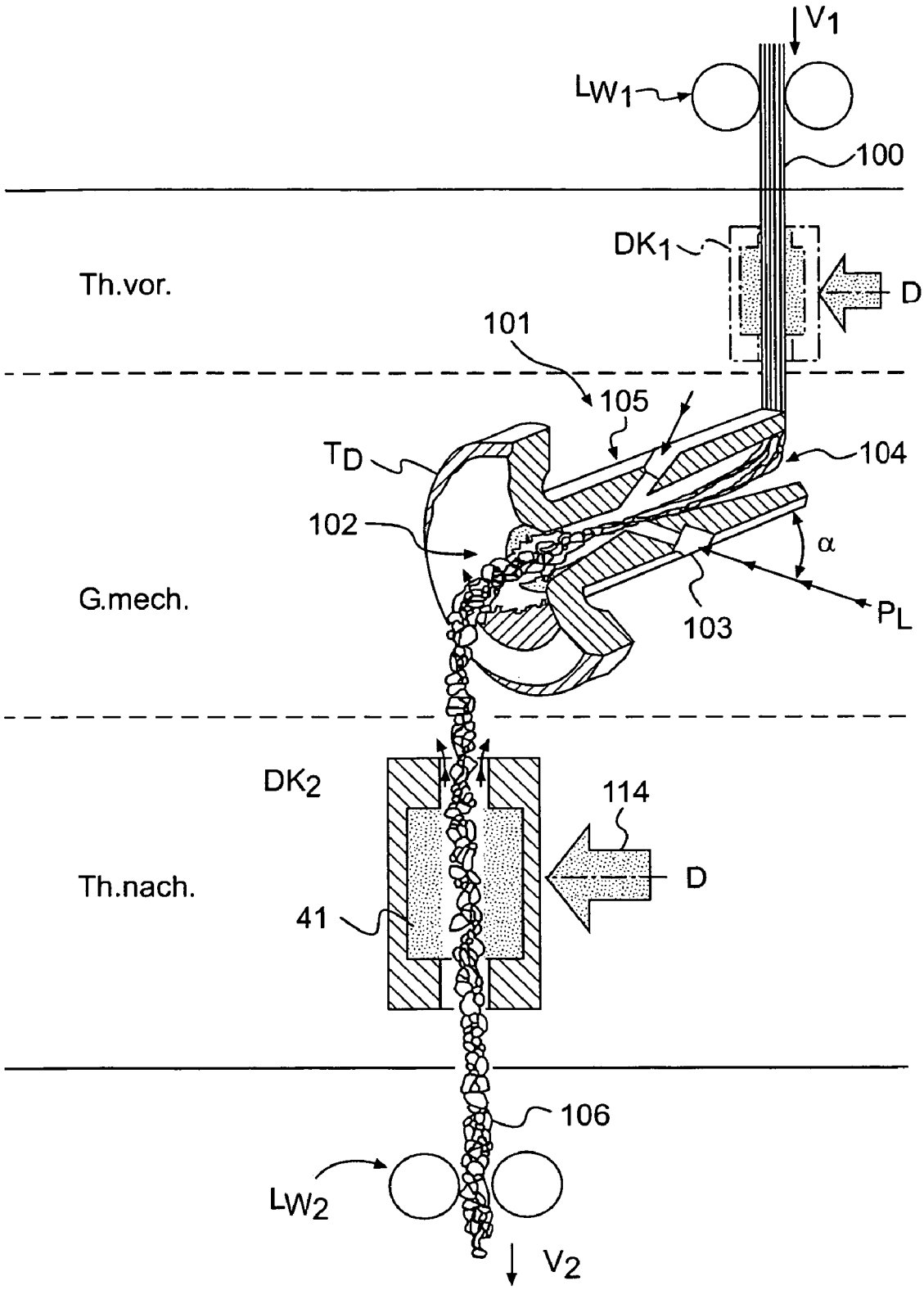
Figure 10A:
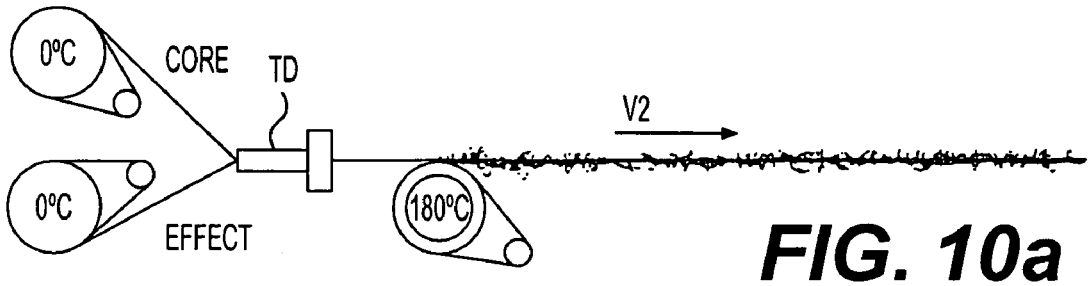
Figure 10B:
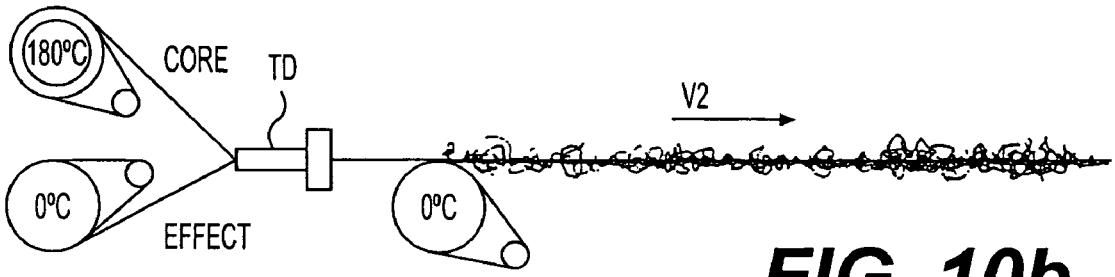
Figure 10C:
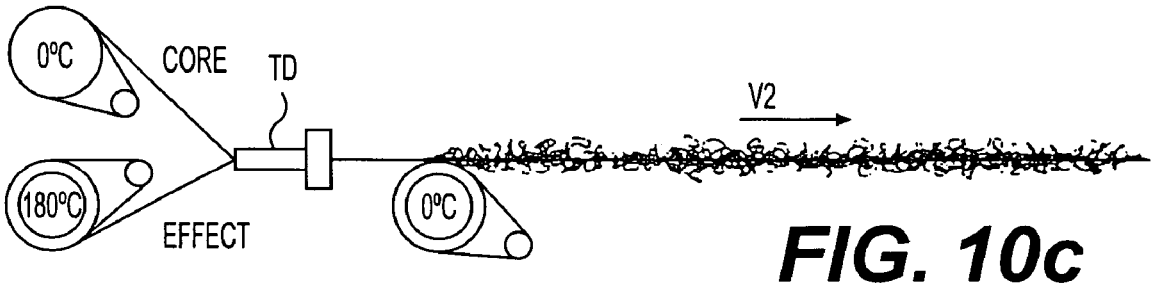
Figure 10D:
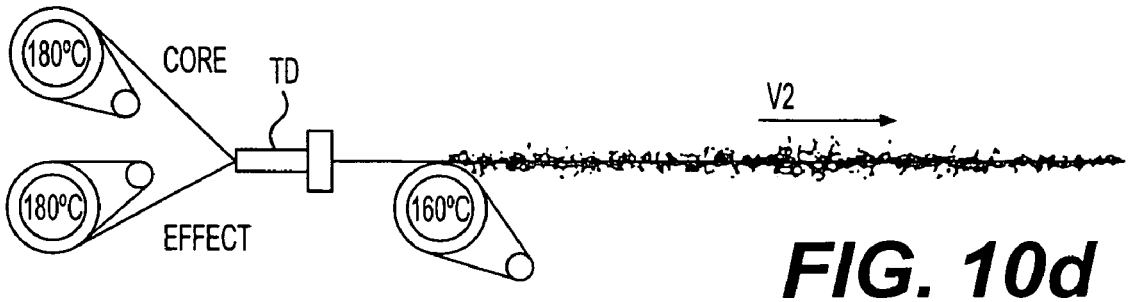

FIG. 9 shows the use of a thermal stage in combination with texturing.

FIG. 10*a* through 10*d* show the thermal use over heated godets.

METHODS AND IMPLEMENTATION OF THE INVENTION

Figure 1:
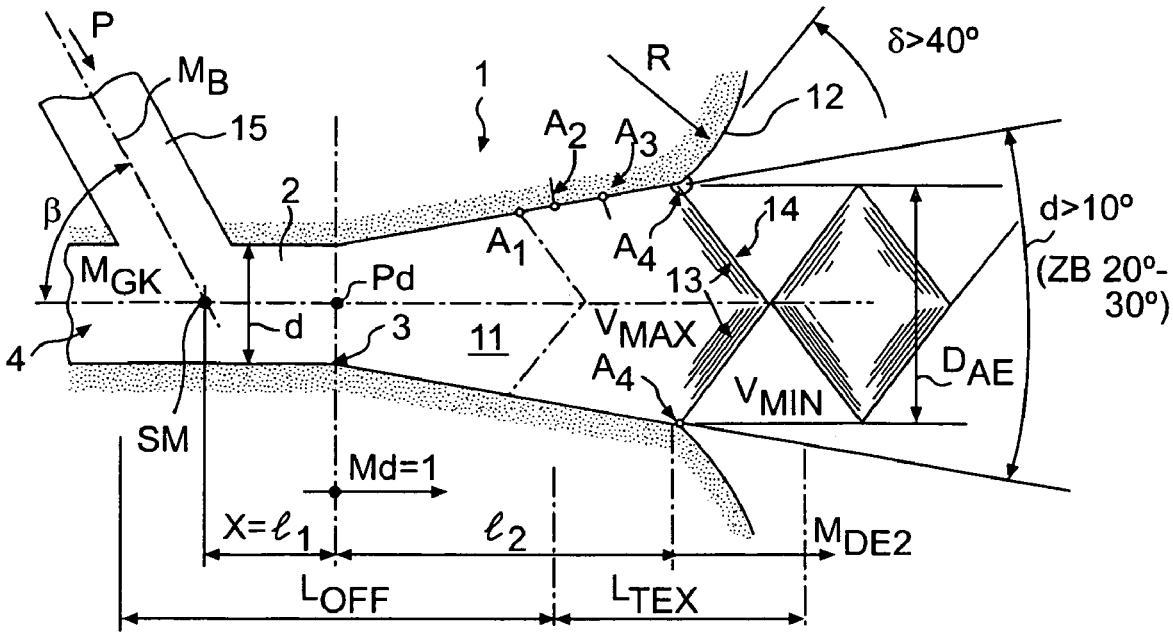
FIG. 1 shows the yarn duct in the area of the yarn opening and texturing zone in accordance with the novel invention.

Reference will be made hereinafter to FIG. 1. The texturing nozzle 1 presents a yarn duct 4 having a cylindrical portion 2 which at the same time corresponds to the narrowest cross section 3 with a diameter d. From the narrowest cross section 3 the yarn duct 4 continues without a sudden change in the cross section into an acceleration duct 11 and is then widened in the shape of a trumpet, whereby the trumpet shape can be defined with a radius R. A corresponding shock wave diameter $DA_E$ can be determined on the basis of the prevailing supersonic flow. The removal or cessation location $A_1$, $A_2$, $A_3$ or $A_4$ can be determined relatively exactly on the basis of the shock wave diameter $DA_E$. As for the effect of the shock wave, reference is made to the EP 0 880 611. The acceleration area of the air can also be defined by the length $l_2$ from the location of the narrowest cross section 3 and the cessation point A. As this is a genuine supersonic flow, the air speed can be calculated roughly from it.

FIG. 1 shows a conical embodiment of the acceleration duct 11 which corresponds to the length $l_2$. The opening angle. $\alpha_2$ is given at about 20°. The removal location $A_2$ is indicated at the end of the supersonic duct, where the yarn duct passes into the unsteady, markedly conical or trumpet-shaped widening 12 with an opening angle δ>40°. The shock wave diameter $D_{AE}$ can be determined geometrically. As an example the following equations are roughly obtained:

$$L2/d = 4.2;\ Vd = 330\ \text{m/sec. (Mach 1)};\ \frac{DAE}{d} \sim 2.5 \rightarrow M_{DE} = \text{Mach } 3.2$$

An extension of the acceleration duct 11 with a corresponding opening angle increases the shock wave diameter $D_{AE}$. The maximum compression shock wave 13 occurs directly in the area of shock wave formation with a subsequent abrupt pressure increase zone 14. The actual texturing takes place in the area of the compression shock wave 13. The air moves faster than the yarn roughly by the factor 50. It was possible to determine by many experiments that the removal location $A_3$, $A_4$ can also travel into the acceleration duct 11, namely when the supply pressure is reduced. In practice, the optimum supply pressure has to be determined now for each yarn, the length ($l_2$) of the acceleration duct being designed for the most undesirable case, and is therefore selected rather too long. $M_B$ designates the central line of the inlet orifice 15, and $M_{GK}$ the central line of the yarn duct 4, and SM the intersection point of $M_{GK}$ and $M_B$. Pd is the location of the narrowest cross section at the beginning of the acceleration duct 11, $l_1$ is the distance between SM and Pd, $l_2$ is the distance between Pd and the end of the acceleration duct (A4). Löff designates roughly the length of the yarn opening zone, Ltex roughly the length of the yarn texturing zone. The wider angle β, the larger the rearward expansion of the yarn opening zone.

Figure 2:
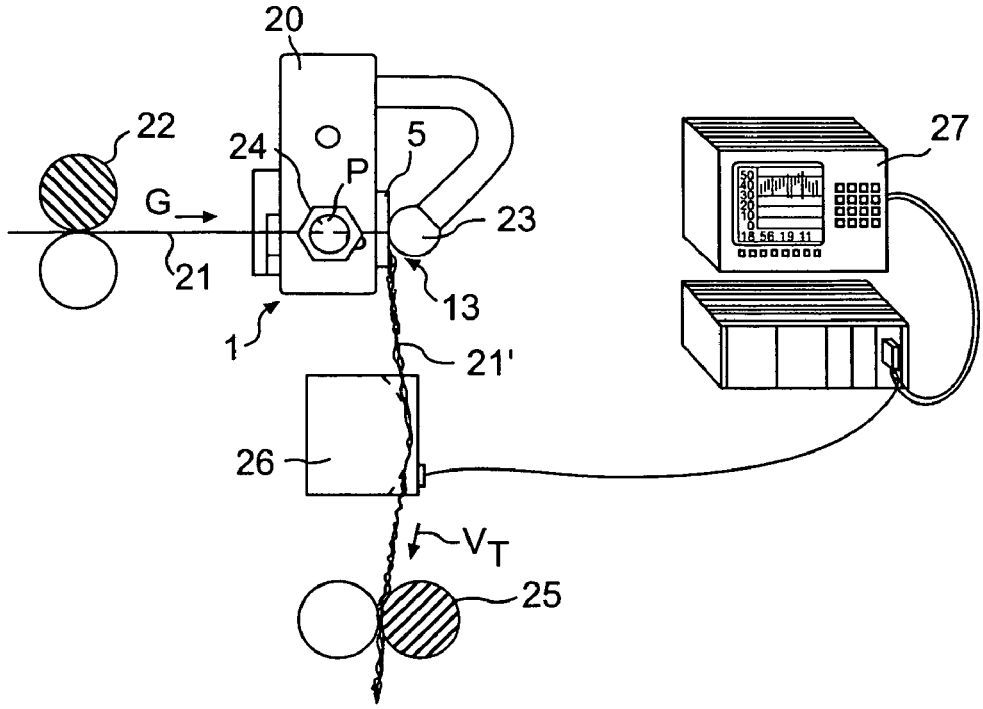
FIG. 2 shows a schematic representation of the yarn tension test during texturing.

FIG. 2 shows a complete texturing head or nozzle head 20 with built-in nozzle core 5. The unprocessed yarn 21 is supplied to the texturing nozzle 1 via a delivery mechanism 22 and is forwarded as textured yarn 21'. An impact member 23 is located in the outlet area 13 of the texturing nozzle. A compressed air connection P' is arranged laterally on the nozzle head 20. The textured yarn 21' travels at a conveying rate VT via a second delivery mechanism 25. The textured yarn 21' is guided via a quality sensor 26, e.g. with the trade name HemaQuality, known as ATQ, in which the tensile force of the yarn 21' (in cN) and the deviation of the instantaneous tensile force (sigma %) are measured. The measurement signals are supplied to a computer 27. The corresponding quality measurement is a condition for the optimum monitoring of the production. The values are also an indicator of the yarn quality. Quality determination is particularly difficult in the air jet texturing process in so far as there is no defined loop size. It is much better to determine the deviation from the quality a customer considers good. This can be performed with the ATQ system because the yarn structure and the deviation thereof can be determined and evaluated via a yarn tension sensor 26 and can be displayed by a single characteristic, the AT value. A yarn tension sensor 26 detects in particular the tensile force of the yarn after the texturing nozzle as an analog electric signal. The AT value is determined continuously from the mean value and variance of the measured values of the tensile force of the yarn. The size of the AT value is dependent on the structure of the yarn and is determined by the user according to his own quality requirements. If the tensile force of the yarn or the variance (uniformity) of the yarn tension varies during production, the AT value also varies. Upper and lower limit values can be determined by yarn levels and samples of knit or woven fabric. They differ according to quality requirements. The advantage of the ATQ measurement resides in the fact that various disturbances of the process can be detected simultaneously, e. g. regularity of texturing, yarn wetting, filament breakages, nozzle contamination, impact member distance, hotpin temperature, air pressure differences, POY insertion zone, yarn presented, etc.

Figure 3:
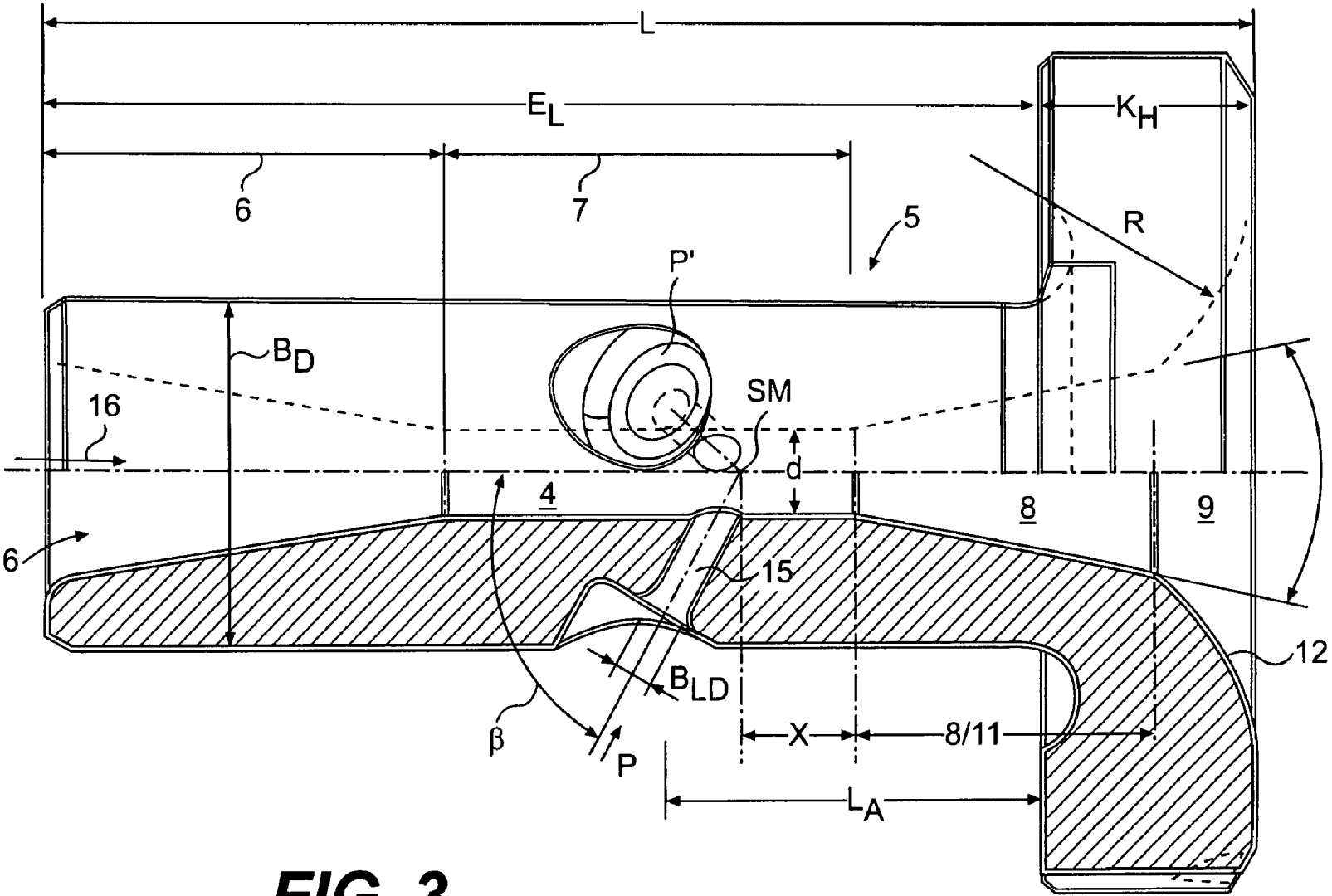
FIG. 3 shows a nozzle core in accordance with the invention in a larger scale.

Reference will be made hereinafter to FIG. 3 which shows a strongly magnified preferred embodiment of a complete nozzle core 5 in a cross section. The outer fitting shape is preferably adapted exactly to the state-of-the-art nozzle cores. This applies in particular to the critical installation dimensions, the orifice diameter $B_D$, the total length L, the nozzle head height $K_H$ as well as the distance $L_A$ for the compressed air connections PP'. The tests have shown that the optimum intake angle β has to be greater than 48°. The distance X of the corresponding compressed air orifices 15 is critical as related to the acceleration duct. The yarn duct 4 has a yarn inlet cone 6 in the yarn inlet area, arrow 16. The outgoing air flow directed backwards is reduced by the compressed air directed in the sense of the yarn conveyance (arrow 16) via the oblique compressed air orifices 15. The dimension "X" (FIG. 6) indicates that the air orifice is set back preferably at least roughly by the size of the diameter d of the narrowest cross section 3. Viewed in the conveying direction (arrow 16), the texturing nozzle 1 and the nozzle core 5, respectively, has a yarn inlet cone 6, a cylindrical central portion 7, a cone 8, which simultaneously corresponds to the acceleration duct 11, and a widened texturing chamber 9. The texturing chamber is delineated transversely to the flow by a trumpet shape 12, which can also be designed as an open conical funnel. FIG. 3 shows a texturing nozzle with three compressed air orifices 1, which are staggered by 120° each and open to the same location Sm in the yarn duct 4.

Figure 4:
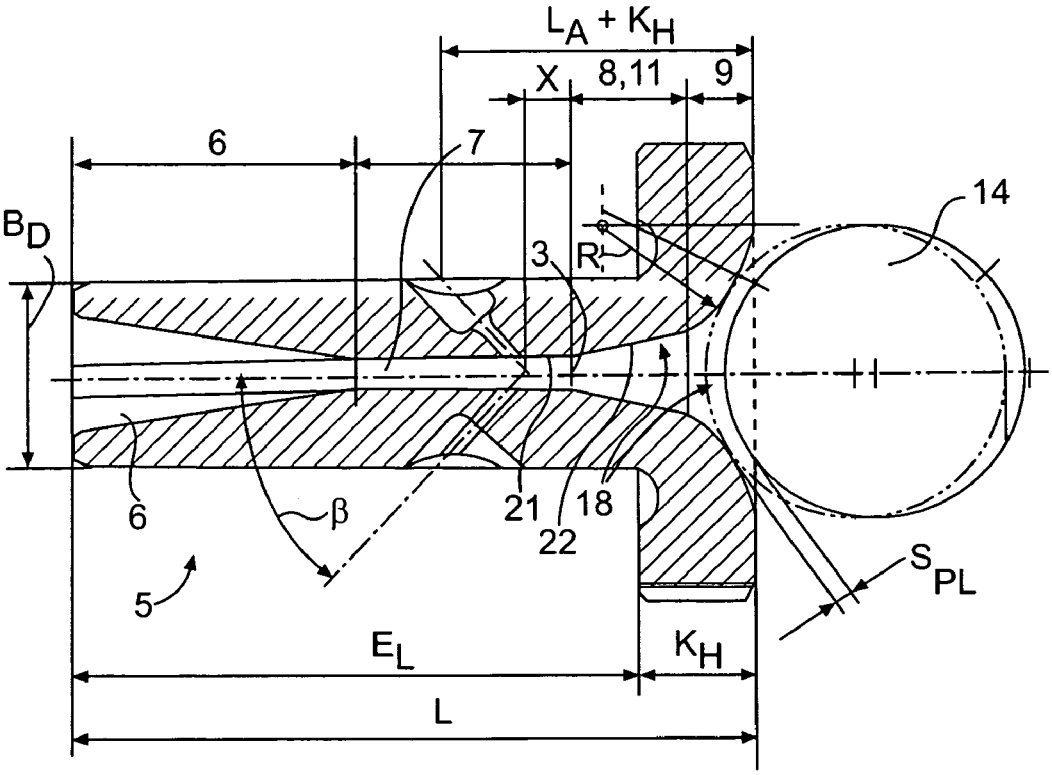
FIG. 4 shows a nozzle core with an impact member at the outlet of the acceleration duct.

FIG. 4 show a nozzle core 5 with an impact body 14 strongly magnified as compared to the actual size. The novel nozzle core 5 can be designed as a replacement core for the previous art. In particular the dimensions $B_d$, $E_L$ as the installation length, $L_A$+$K_H$ as well as $K_H$ are therefore preferably manufactured not only equal, but also having the same tolerances. Furthermore, the trumpet shape is preferably also produced identically in the external outlet area to the state of the art with a corresponding radius R. The impact member 14 can be of any shape: spherical, flat ball-shaped or even in the form of a cap. The exact position of the impact member in the outlet region is retained by maintaining the external dimensions, corresponding to an identical take-off gap $S_{p1}$. The texturing chamber 18 remains externally unchanged, but is now directed backwards and defined by the acceleration duct 11. The texturing chamber can also be enlarged into the acceleration duct, depending on the value of the selected air pressure. As with the state of the art, the nozzle core 5 is produced from a high-quality material such as ceramic, hard metal or special steel and is actually the expensive part of a texturing nozzle. It is important with the novel nozzle that the cylindrical wall surface 21 as well as the wall surface 22 is of optimum quality in the area of the acceleration duct. The constitution of the trumpet-shaped widening is determined with regard to yarn friction.

Figure 5:
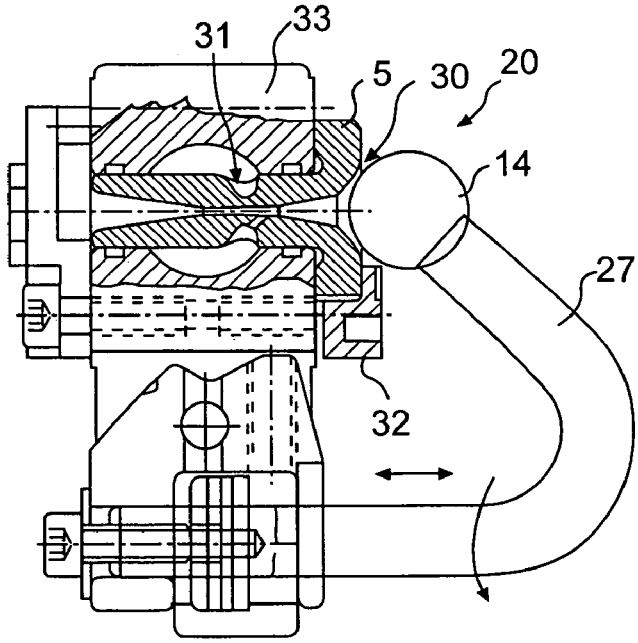
FIG. 5 shows a complete nozzle head with an impact member.

FIG. 5 shows a complete nozzle head 20 with a nozzle core 5 as well as an impact member 14, which is adjustable by an arm 27 and secured in a known housing 28. For threading purposes, the impact member 14 is drawn and swung away, respectively, with the arm 27 from the working area 30 of the texturing nozzle in a known manner as indicated by arrow 29. The compressed air is supplied from a housing chamber 31 via compressed air orifices. The nozzle core 5 is firmly clamped on the housing 33 by a clamping member 32. Instead of a ball shape, the impact member can also have a cap shape.

Figure 6:
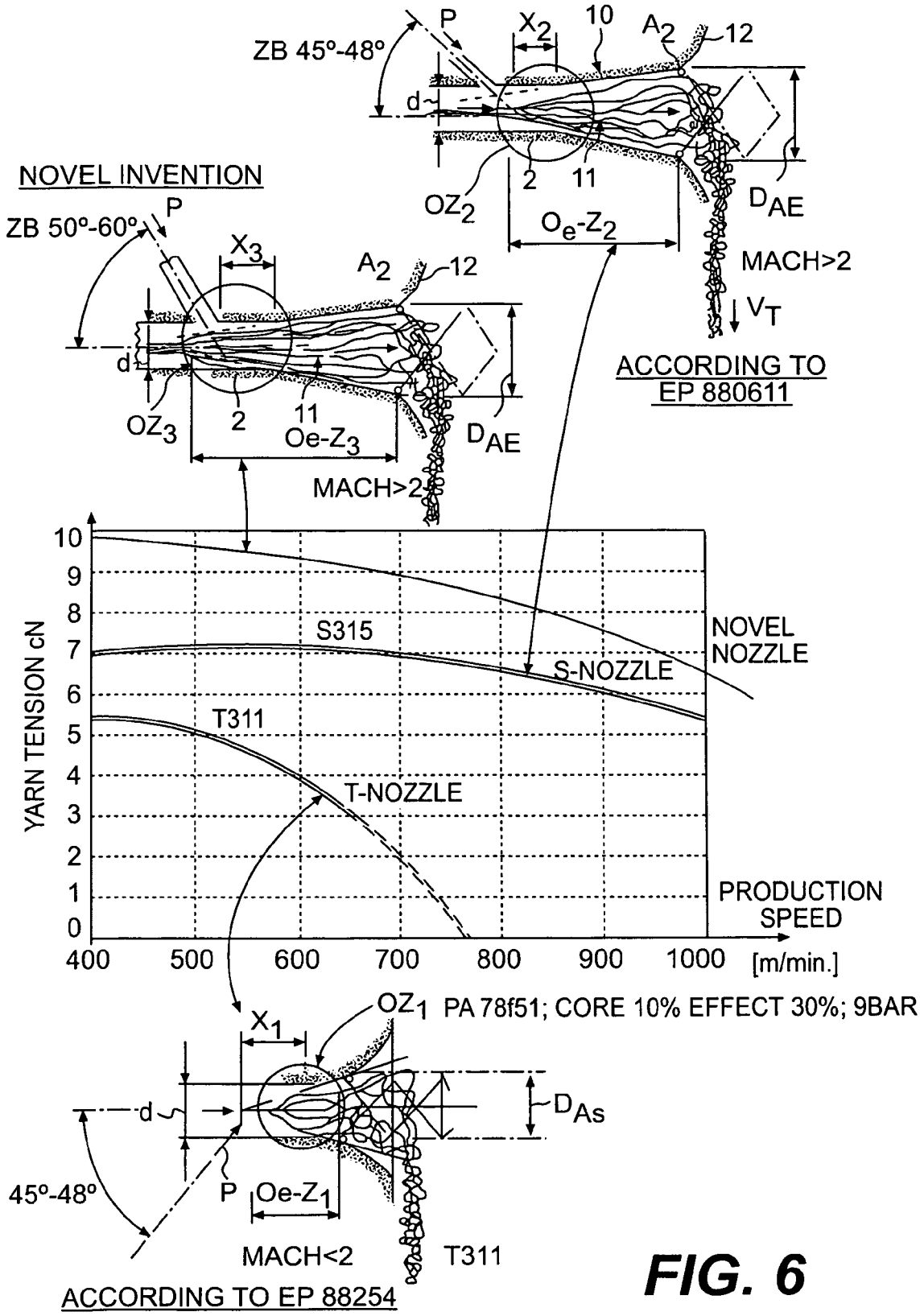
FIG. 6 shows a comparison of textured yarn pursuant to the state of the art with the novel invention as related to the yarn tension.

The bottom left-hand corner of FIG. 6 shows the state-of-the-art texturing in accordance with the EP 0 088 254 purely schematically. Two main parameters are emphasized: An opening zone Oe-$Z_1$ as well as a shock wave diameter DAs, starting from a diameter d corresponding to a nozzle described in the EP 0 088 254. On the other hand the texturing in accordance with the EP 0 880 611 is shown in the top right-hand corner. It can be seen very clearly that the values Oe-$Z_2$ as well as $D_{AE}$ are greater. The yarn opening zone Oe-$Z_2$ begins shortly before the acceleration duct in the area of the compressed air supply P and is already markedly greater as related to the relatively short yarn opening zone Oe-$Z_1$ of the solution in accordance with the EP 0 088 254.

The essential message of FIG. 6 resides in the diagrammatic comparison of the yarn tension in accordance with the state of the art (curve T 311) with Mach<2 and a texturing nozzle in accordance with the invention (curve S 315) with Mach>2 as well a the novel nozzle. The vertical column of the diagram shows the yarn tension in CN. The horizontal line depicts the production rate Pgeschw. in m/min. The curve T 311 shows the clear collapse of the yarn tension above a production rate of 500 m/min. Texturing conducted with the nozzle in accordance with the EP 0 088 254 broke down above about 650 m/min. In contrast, curve S 315 with the corresponding nozzle in accordance with the EP 0 880 611 shows that the yarn tension is not only much higher but is almost constant in the range between 400 and 700 m/min and decreases only slowly even in the higher production range. The increase of the Mach number is one of the most important parameters for the intensification of the texturing. The increase of the supply angle is one of the most important parameters for the quality of texturing, which is depicted as a third example with the novel nozzle in the top left-hand corner. As an example the supply angle is indicated in the range between 50° and 60°. The yarn opening zone Oe-$Z_3$ is greater than the one in the solution in the top right-hand corner (in accordance with the EP 0 880 611) and substantially greater than in the solution in the lower left-hand corner (in accordance with the EP 0 088 254). The other procedural parameters of the method are identical for all three solutions. Besides the different supply angle in the range between 45° and 48° and new above 45°, the surprisingly positive effect is found in the first portion of the yarn opening zone, such as $OZ_1$ and $OZ_2$ and as marked in the corresponding circle, respectively. As depicted in FIGS. 7 and 8, the external difference exclusively resides in the changed supply angle. The marked increase of the yarn tension starts at an angle of more than 48° and can only be explained by a combinatory effect. In so far as the surprisingly positive effect is currently understood, a supply angle of 48° represents a threshold, but only with texturing nozzles in accordance with the EP 0 880 611. This type of texturing nozzle has a sufficient performance reserve such that even a slight intensification of the yarn opening is translated into an increased yarn quality.

Figure 7A:
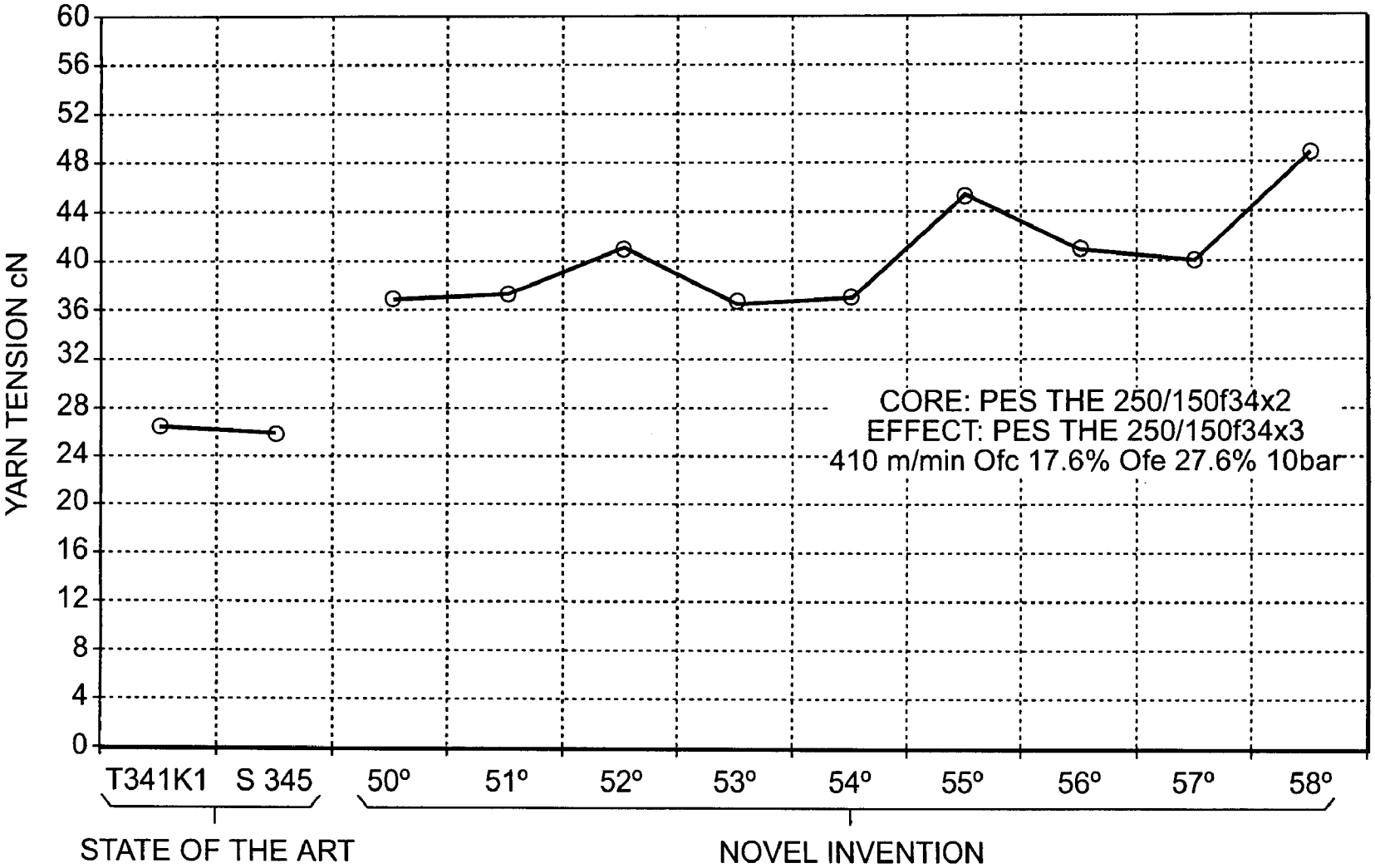
Figure 7B:
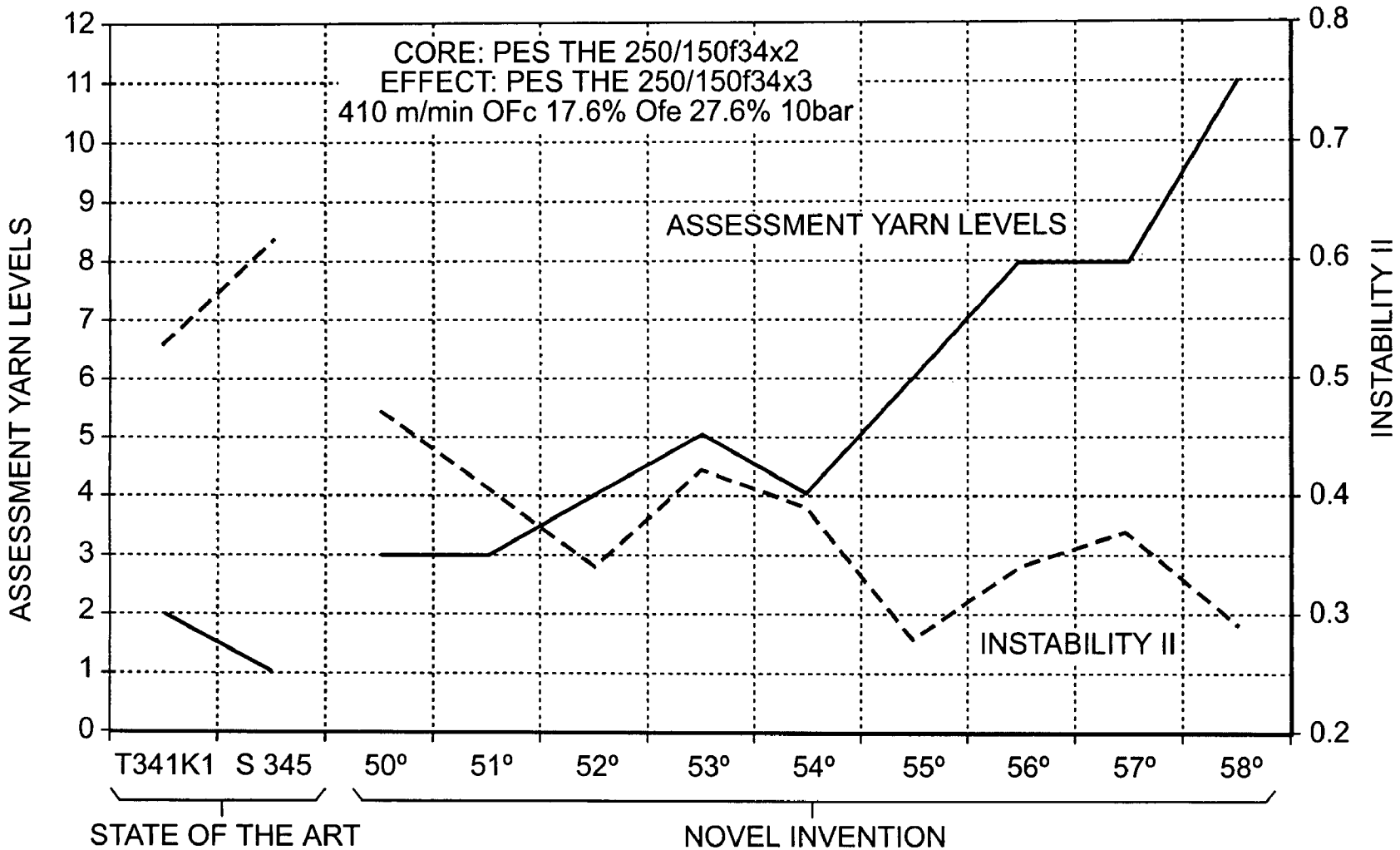
Figure 7C:
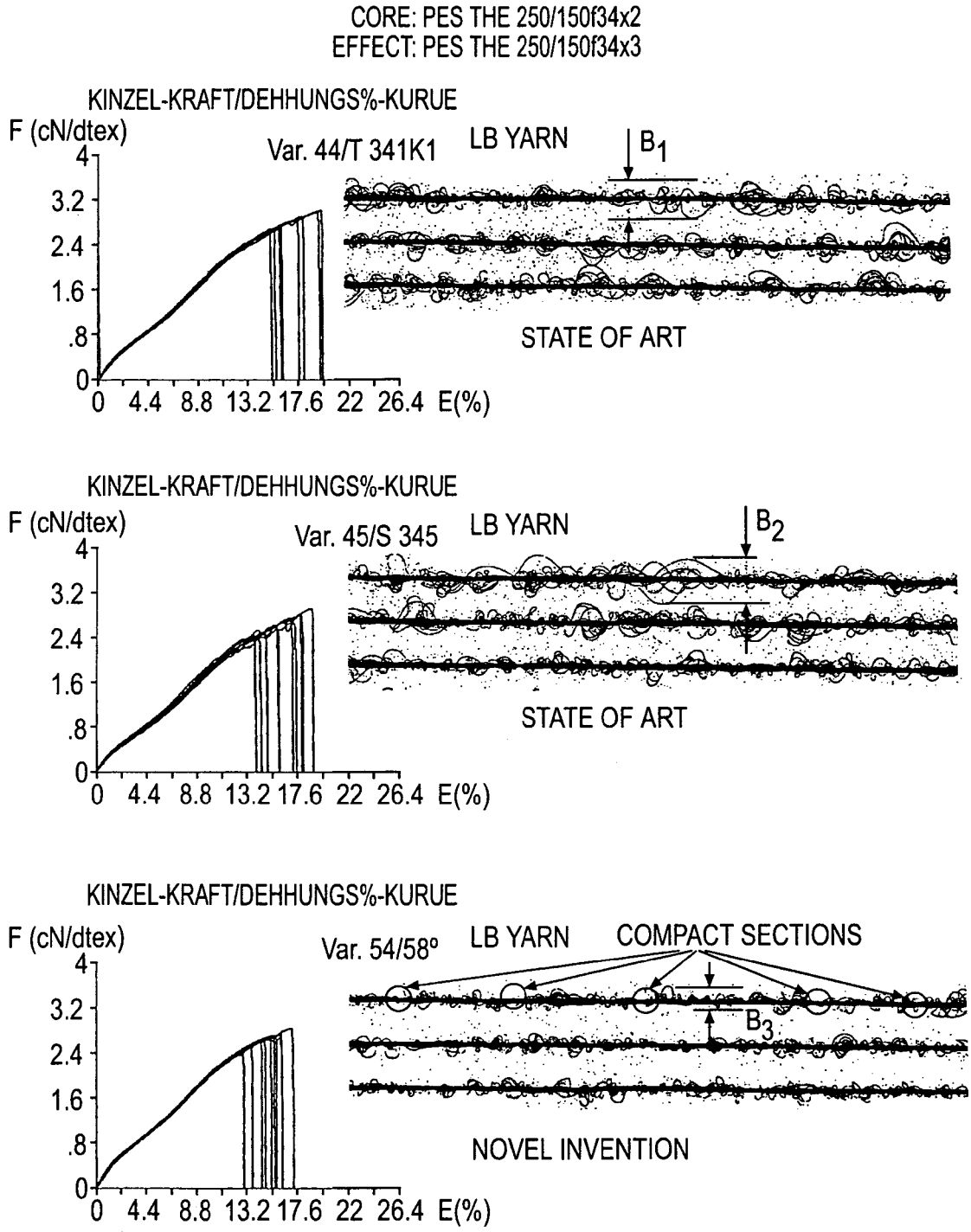
Figure 8A:
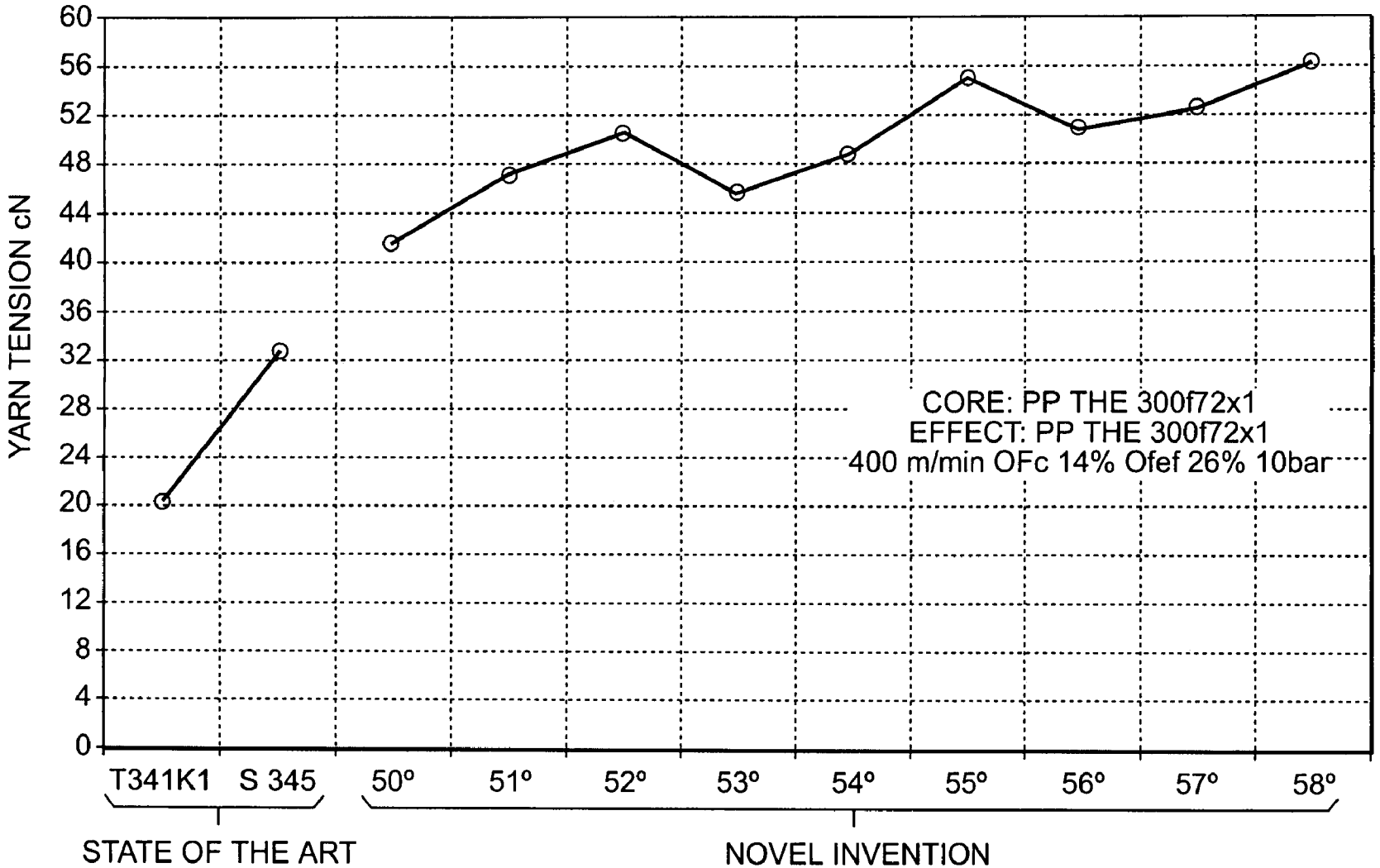
Figure 8B:
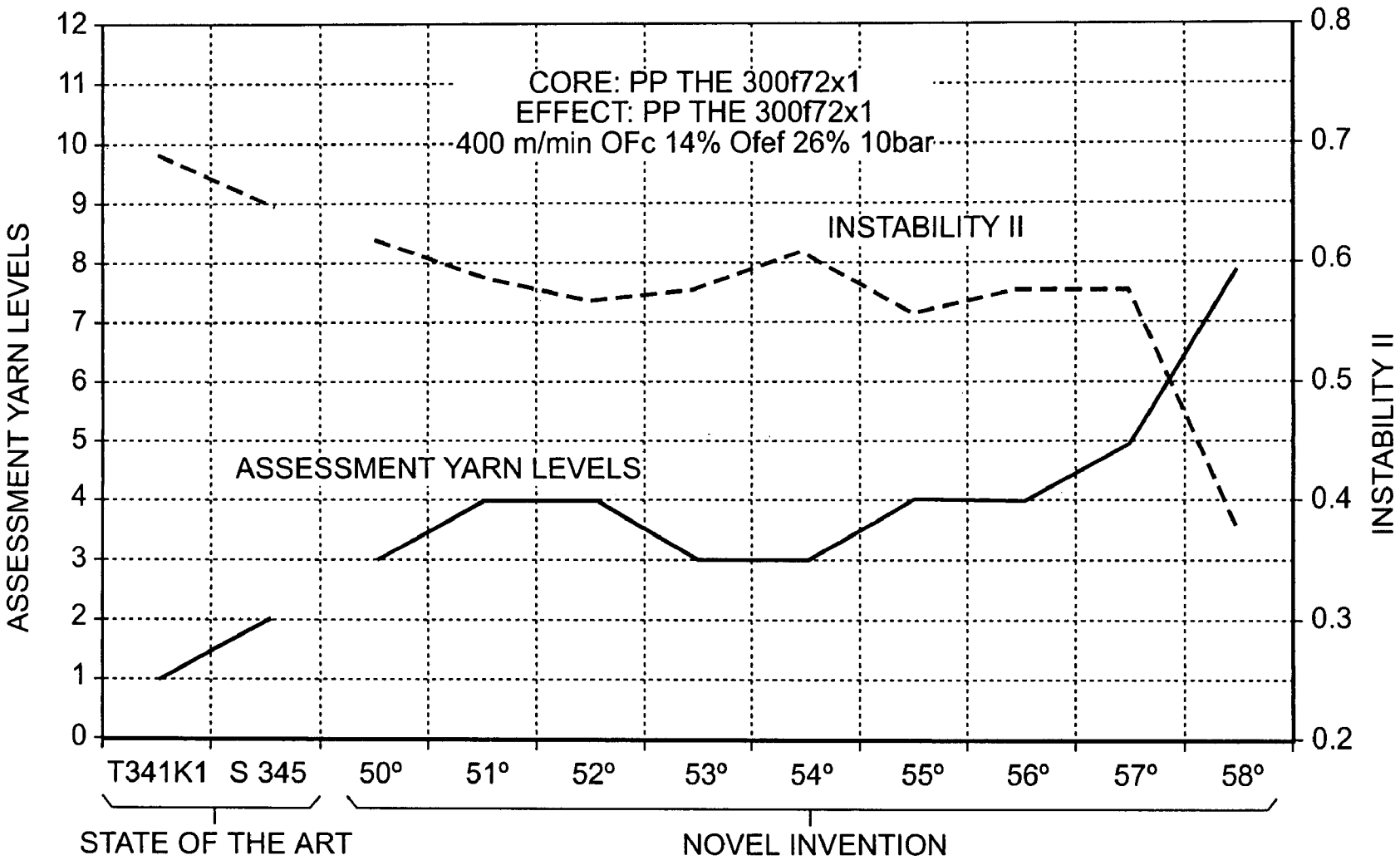
Figure 8C:
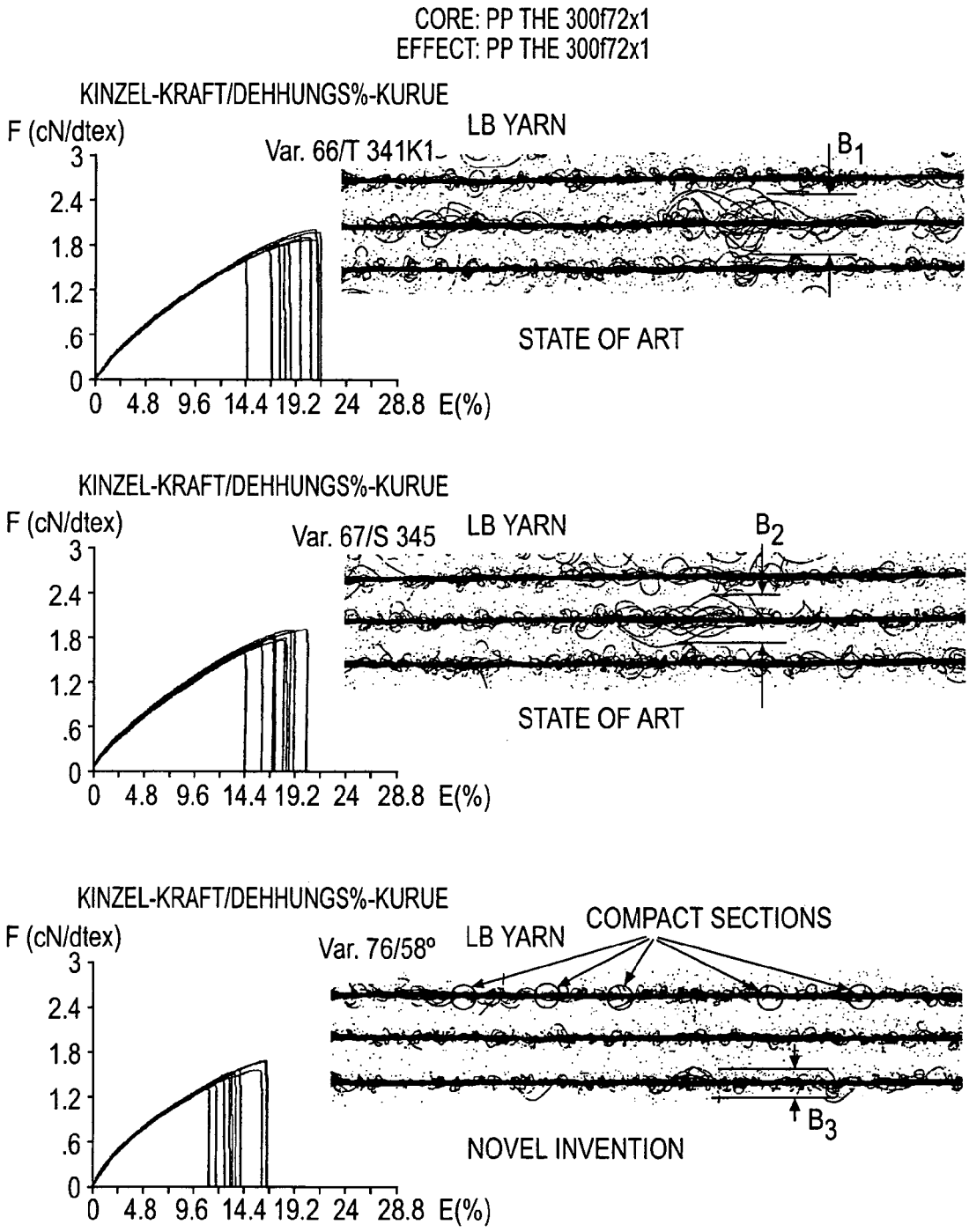

The FIGS. 7*a* through 7*c* and 8*a* through 8*c* show diagrammatically the relations of various parameters related to the state of the art (T341 $K_1$ as well as S345) as well as the texturing nozzles in accordance with the invention with supply angles between 50° and 58°. In FIG. 8*a*, the yarn tension increases from left to right markedly strongly from some 20 cN to 56 cN. In the example portrayed, the yarn tension is more than doubled on average with the novel invention. FIG. 7*a* shows a yarn tension that initially increases less markedly. To date all tests have led to variations for the two diagrams 7*a* and 8*a* and hence to the finding that the yarn tension is markedly greater above a supply angle of 48°. Both FIG. 7*c* and 8*c* show three differently textured yarn patterns each. The upper yarn patterns were produced with nozzles in accordance with the state of the art, the uppermost pursuant to the EP 0 088 254 (T-nozzle) and the middle one pursuant to the EP 0 880 611 (S-nozzle). The patterns in the bottom part were produced with texturing nozzles in accordance with the novel invention. Relatively widely protruding loops with a lack of compact sections are noted immediately for the yarn patterns produced pursuant to the state of the art. The dimension $B_1$ and $B_2$ indicates the size of the distance for the most protruding loops. For the two lower yarn patterns, the dimension $B_3$ is substantially smaller. In particular, however, very compact sections and still relatively dense sections with many loops are noted in short sequence. But the essential aspect resides in the fact that the yarn patterns react extremely different under a load. If the yarn patterns in accordance with the state of the art (top and center) are placed under a tensile stress, the loops open too much and do not form again once the tensile stress is removed. In contrast the loops in the yarn patterns in accordance with the novel invention remain almost fully intact including after removal of the tensile stress. This means that the quality of texturing had been noticeably increased in a twofold way, a fact that was confirmed with all yarn titers tested so far. Moreover it is an interesting fact that it was possible to confirm the corresponding increase in quality and performance including with the novel invention when a thermal effect in accordance with the WO99/45182 was applied. The EP 1 058 745 is declared an integral part for the corresponding additional combinatory effect.

Reference will be made hereinafter to FIG. 9, which shows a schematic overview related to the novel texturing method. From top to bottom the separate procedural stages are represented sequentially. Smooth yarn 100 is guided to a texturing nozzle 101 and through the yarn duct 104 from the top via a first delivery mechanism LW1 at a conveyance rate V1. Highly compressed air, preferably not heated, is supplied at an angle α in the direction of conveyance of the yarn into the yarn duct via compressed air ducts 103 connected to a compressed air source P1. Immediately following, the yarn duct 104 is conically opened such that in the conical portion 102 a massively accelerated supersonic air flow, preferably at more than Mach 2, is generated. The shock waves create—as described in detail in the WO97/30200 mentioned above—the actual texturing. The first portion from the air supply location 105 into the yarn duct 104 through to the first portion of the conical widening 102 serves for the loosening and opening of the smooth yarn such that the individual filaments are subjected to the supersonic flow. Depending on the size of the available air pressure (9 . . . 12 up to 14 bar and more) the texturing takes place either yet inside the conical portion 102 or in the outlet area. There is a direct proportionality between the Mach number and the texturing. The larger the Mach number, the higher the shock effect and the more intense the texturing. Two critical parameters were noted for the production rate:

the desired quality standard, and the trembling, which can cause the texturing to collapse, if the conveyance rate is further increased.

The following abbreviations are used:

Th.vor. Thermal pre-treatment, possibly only by heating the yarn or by using hot vapor.

G.mech. Treatment of the yarn with the mechanical effect of a compressed air flow (supersonic flow).

Th.nach. Thermal post-treatment with hot vapor (possibly only heat and hot air, respectively).

D. Vapor

PL. Compressed air.

It was possible, by additional thermal treatment, to increase the production rate to up to 1500 m/min without a collapse of the texturing and without trembling, whereby the existing test system was the limiting condition. Best texturing qualities were obtained at production rates much higher than 800 m/min. Surprisingly, the inventors discovered one and two completely new quality parameters, respectively, whereby all tests only confirmed the rule mentioned above (higher Mach number=stronger surge=more intense texturing). On the one hand the discovered parameters reside in a heat treatment before and after the texturing, respectively, and—on the other—in an increase of the Mach number by raising the air pressure as well as a corresponding design of the acceleration duct.

a) Thermal post-treatment or relaxation

Specialists consider the yarn tension of the yarn leaving the texturing nozzle an important quality criterion for texturing, which is also recognized as a measure for the intensity of the texturing. The yarn tension on the textured yarn 106 is generated between the texturing nozzle (TD) and the delivery mechanism LW2. A thermal treatment of the yarn subjected to a tensile stress was conducted in this area between texturing nozzle (TD) and delivery mechanism LW2. In this process the yarn was heated to some 180° C. First tests could already be completed successfully both with a hotpin or a heated godet and also with a hotplate (contact-free), with the surprising result that the quality limit related to the conveyance rate could be massively increased. At present it is assumed that the described thermal post-treatment has a fixing and simultaneously a shrinking effect on the textured yarn and thereby supports the texturing.

b) Thermal pre-treatment

Much more surprisingly, the thermal pre-treatment similarly had a positive effect on the texturing process. Here the cause for success is deemed to be a combinatory effect of shrinking and yarn opening in the portion between the air supply location in the yarn duct and the first part of the conical widening in the area of the supersonic speed. The stiffness is reduced by warming up the yarn which improves the preconditions for looping in the texturing process. Including for this aspect, tests were successfully completed both with hotplate and hotpin as a source of heat. Possibly the fact helps that the thermal pre-treatment of the yarn avoids a negative cooling effect of the air expansion in the texturing nozzle and consequently texturing can be improved for the warmed-up yarn. Owing to the extremely high conveyance rate, a part of the heat remains in the yarn even until it reaches the area of looping.

FIG. 9 shows the effect of a processing medium, be it by hot air, hot vapor or another hot gas, conducted on the conveyed yarn shortly and immediately subsequently, respectively. The interferences with the procedure are hence not isolated, but integrated into a combined effect between two delivery mechanisms. This means that the yarn is held only initially and at the end, in between there is both the mechanical application of the air and the thermal treatment. The thermal treatment is conducted on the yarn which is still subjected to tensions in the filaments and in the yarn, respectively, which are generated mechanically by compressed air.

FIGS. 10*a* through 10*d* represent examples for a mechanical and thermal effect separated in terms of space. The effect takes place spatially before or after the actual texturing, respectively. In this context, the warming up of the yarn can—if only to a rather limited degree—be positively used for the texturing. The FIGS. 10*a* through 10*d* show the use of the so-called heated and driven godets for the thermal treatment with several important possible uses. The temperature reading in the godet shows for each case if a heated position is present. By analogy, a hotplate or a continuous-flow vapor chamber in accordance with the invention can also be used for all presentations.

The invention claimed is:

1. A method for treating yarn, comprising:

conveying yarn through a yarn duct defined by a texturing nozzle;

supplying compressed air into the yarn duct substantially in a conveying direction of the yarn, wherein the compressed air is supplied at a pressure of more than 4 bar and at an angle of more than 48 degrees with respect to a longitudinal axis of the yarn duct, wherein an outlet portion of the yarn duct conically widens at an angle of more than about 10 degrees with respect to the longitudinal axis of the yarn duct so as to generate a supersonic flow.

2. The method of claim 1, wherein the compressed air is supplied at an angle of more than 50 degrees with respect to the longitudinal axis of the yarn duct.

3. The method of claim 1, wherein the compressed air is supplied at an angle ranging from 49 degrees to 80 degrees with respect to the longitudinal axis of the yarn duct.

4. The method of claim 1, wherein the compressed air is supplied at an angle ranging from 50 degrees to 70 degrees with respect to the longitudinal axis of the yarn duct.

5. The method of claim 1, wherein the yarn duct defines a cylindrical portion in flow communication with the conically widening outlet portion, and the compressed air is supplied into the cylindrical portion.

6. The method of claim 5, wherein the compressed air is supplied into the cylindrical portion of the yarn duct at a location where opening of the yarn occurs.

7. The method of claim 5, wherein the angle at which the compressed air is supplied is a function of yarn titer.

8. The method of claim 1, wherein the compressed air is supplied at an angle of more than 48 degrees and less than 80 degrees, and wherein intermingling of yarn filaments is substantially avoided.

9. The method of claim 1, further comprising thermally treating the yarn prior to conveying the yarn through the texturing nozzle.

10. The method of claim 9, further comprising thermally treating the yarn after conveying the yarn through the texturing nozzle.

11. The method of claim 1, further comprising thermally treating the yarn after conveying the yarn through the texturing nozzle.

12. An apparatus for treating yarn, comprising:

a texturing nozzle defining a yarn duct having an inlet and a longitudinal axis; and at least one compressed air supply orifice disposed so as to supply compressed air into the yarn duct substantially in a direction of a conveying direction of yarn through the yarn duct and at an angle of more than about 48 degrees with respect to the longitudinal axis of the yarn duct, wherein an outlet portion of the yarn duct conically widens at an angle of more than about 10 degrees with respect to the longitudinal axis of the yarn duct so as to generate a supersonic flow.

13. The apparatus of claim 12, wherein the at least one air supply orifice is only one air supply orifice.

14. The apparatus of claim 12, further comprising three air supply orifices each arranged so as to supply air to the same location along the longitudinal axis of the yarn duct.

15. The apparatus of claim 14, wherein each of the three air supply orifices are disposed about 120 degrees apart around the yarn duct.

16. The apparatus of claim 12, wherein the yarn duct defines a cylindrical portion in flow communication with the conically widening outlet portion, and the compressed air is supplied into the cylindrical portion.

17. The apparatus of claim 16, wherein the at least one air supply orifice is offset from the conically-shaped outlet portion by at least one diameter of the cylindrical portion.

18. The apparatus of claim 16, wherein the cylindrical portion and the conically-shaped outlet portion are portions of a nozzle core.

19. The apparatus of claim 18, wherein the nozzle core is configured to be removably inserted into a texturing nozzle head.

20. The apparatus of claim 18, further comprising a plurality of nozzle cores each formed from a cylindrical portion and a conically-shaped outlet portion of differing dimensions.

21. The apparatus of claim 18, wherein the nozzle core is made a material resistant to wear.

22. The apparatus of claim 18, wherein the nozzle core is made of a ceramic material.

23. The apparatus of claim 12, further comprising an impact member disposed at an outlet end of the conically-shaped outlet portion.

24. The apparatus of claim 23, wherein the impact member is adjustable so as to alter its position relative to the outlet end.

25. The apparatus of claim 19, wherein the texturing nozzle is part of the texturing nozzle head.

26. The apparatus of claim 25, wherein the at least one air supply orifice includes three air supply orifices.

27. The apparatus of claim 26, wherein the at least one compressed air supply is configured to supply compressed air at a pressure of more than 4 bar.

* * * * *